United States Patent [19]

Best

[11] Patent Number: 4,785,750

[45] Date of Patent: Nov. 22, 1988

[54] AUTOMATIC MEANS OF ACCURATELY DETECTING AND CUTTING FABRIC PANELS

[75] Inventor: Robert H. Best, Greensboro, N.C.

[73] Assignee: Burlington Industries, Inc., Greensboro, N.C.

[21] Appl. No.: 885,443

[22] Filed: Jul. 14, 1986

[51] Int. Cl.[4] ..... D05B 97/00; D05B 13/00; D05B 37/04; D05B 35/00

[52] U.S. Cl. ..... 112/262.1; 112/10; 112/130; 112/131

[58] Field of Search ..... 112/262.1, 262.3, 10, 112/130, 131, 262.2

[56] References Cited

U.S. PATENT DOCUMENTS

| | | | |
|---|---|---|---|
| 918,813 | 4/1909 | Armstrong . | |
| 2,581,937 | 1/1952 | Secrest . | |
| 3,126,848 | 3/1964 | Gastonguay | 112/10 |
| 3,133,466 | 5/1964 | Seifert | 112/130 X |
| 3,361,021 | 1/1968 | Toth . | |
| 3,661,106 | 5/1972 | Huddelston | 112/262.1 |
| 3,723,122 | 3/1973 | Yano et al. . | |
| 3,962,730 | 6/1976 | Robinson . | |
| 4,370,936 | 2/1983 | Moyer | 112/130 X |
| 4,658,741 | 4/1987 | Jehle et al. | 112/131 X |

*Primary Examiner*—H. Hampton Hunter

*Attorney, Agent, or Firm*—Nixon & Vanderhye

[57] ABSTRACT

Pattern printed textile products, such as pillow cases and items of apparel, are produced in such a manner that the pattern is always properly positioned on the final product. The pattern is printed on a fabric web while it moves in a first direction, and in synchronization with the pattern printing a magnetic mark is disposed (e.g. jet printed) on the web in a known position adjacent the pattern in the direction of fabric movement. A number of marks may be printed, which define the perimeter portions of the fabric if cut into fabric panels. Subsequently, the magnetic marking on the fabric is detected, the fabric is stopped, and rough cut is made at a known position with respect to the mark. A fine cut later severs the mark from the rest of the fabric. Automatic hemming can take place during fine cutting, and after fine cutting and hemming, other steps are performed to turn the fabric into a final textile product.

28 Claims, 5 Drawing Sheets

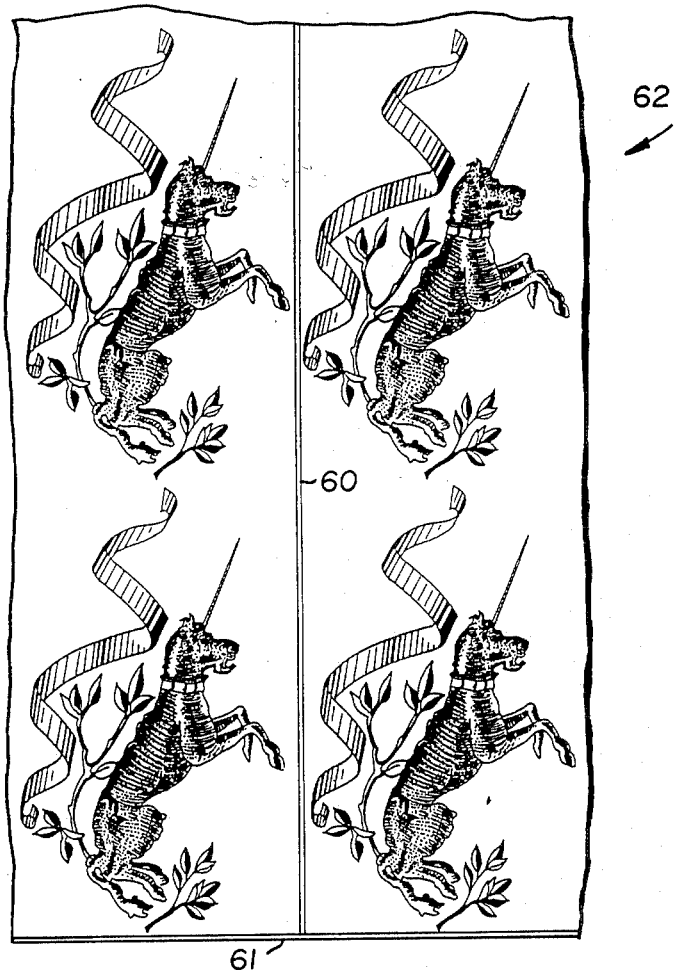
FIG. 12
FIG. 6
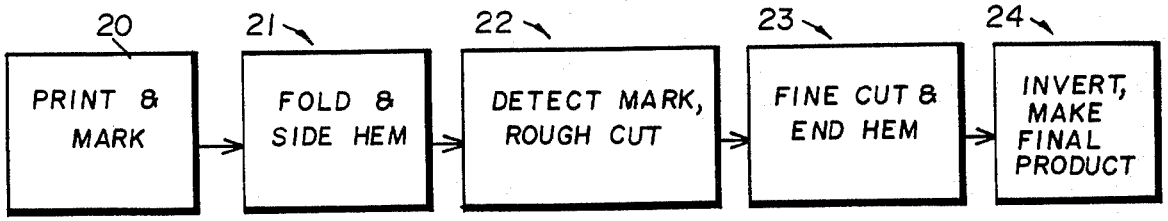
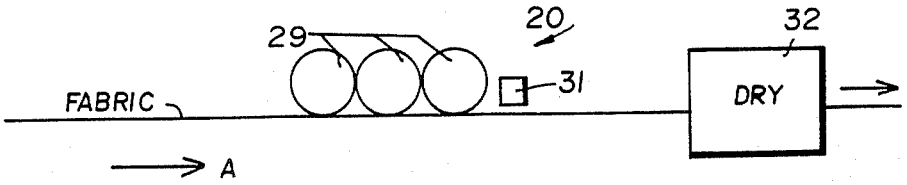
FIG. 7

AUTOMATIC MEANS OF ACCURATELY DETECTING AND CUTTING FABRIC PANELS

BACKGROUND AND SUMMARY OF THE INVENTION

In the manufacture of textile products from pattern printed fabrics, problems of properly automatically cutting the fabric with respect to the pattern so that in the desired textile products produced the pattern is centered and/or can be readily matched up, exist. For example, in the manufacture of pillow cases, a roll of fabric slightly more than twice as wide as the pillow case to be made is passed through a folding device which folds one edge of the fabric over the other. From this the folded fabric passes through a hemmer/cutter which trims the two edges evenly and forms a side hem. The fabric then moves to a cutting table where the leading edge of the fabric, or an obvious point of the print design, is detected by a photo cell. The signal from the photo cell then causes the fabric to be stopped at a preset point on the table and after the material has stopped the cutter (positioned a fixed distance away from the photo cell detection point) is automatically activated and cuts the fabric to the correct length. This fabric is then automatically removed from the table and passed through another hemmer/cutter which hems the end of the pillow case, and the pillow case is subsequently inverted to produce the final product.

It has been found in actual practice that photo cell detection of the leading edge or a contrasting spot on the pattern during pillow case manufacture is not sufficient to assure accurate cutting. Oftentimes, the pattern will not be centered on the pillow case panel. This is because the fabric tends to stretch or shrink on the roll and simply cutting a measured length rather than exactly on line with the pattern does not assure accurate placement of the print pattern on the pillow case panel. Also, the operator must constantly monitor the cutting procedure and make adjustments on the fabric drive every several cuts in order to prevent miscutting of the fabric. Also, each time the pattern is changed the operator must go through a set-up procedure to adjust the photo cell for optimum sensing.

Similar problems to those described above exist when cutting fabric automatically into panels for any use, such as cutting fabric into panels having patterns, in which the patterns from the panel must subsequently be matched up to sew them together, as in the production of apparel fabric, for example.

According to the present invention, a method is provided for forming pattern printed textile products which overcomes the pattern positioning problems discussed above. According to the present invention, while a pattern is being printed on the fabric web, in synchronization with the pattern being printed, a magnetic mark is disposed on the fabric web at a known position adjacent the pattern. If desired, a plurality of marks may be provided to define the perimeter for subsequent automatic cutting of fabric panels.

Subsequently, the magnetic mark is detected, and the fabric is cut at a known position with respect to the mark to form a web section with a known position of a pattern thereon. The web section is ultimately formed into the final textile product. For example, when pillow cases are being formed, the same steps as discussed above with respect to the prior art production of pillow cases are practiced, except that since the detection is done of the magnetic mark, the cutting is much more accurate. When the end seam is formed on the pillow case, the magnetic mark may be cut off of the fabric web so that it does not exist in the final product produced.

In the production of apparel fabric, the perimeters of fabric panels to be matched together are defined during disposition of the magnetic marks on the fabric web, and after the fabric panels are matched together and hemmed, the magnetic marks may again be cut off during that procedure.

It is the primary object of the present invention to produce textile products from pattern printed fabrics wherein the products can be produced automatically or semi-automatically with the patterns properly positioned in the final textile product. This and other objects of the invention will become clear from an inspection of the detailed description of the invention, and from the appended claims.

BRIEF DESCRIPTION OF THE DRAWINGS

FIG. 6 is a schematic view illustrating the method steps in the production of pillow cases according to the present invention;

FIG. 7 is a side schematic view indicating the printing and marking step of the method of FIG. 6;

FIG. 12 is a top plan view of a portion of a pair of panels which have been produced according to the method of the invention and pattern matched in the production of an item of apparel fabric.

DETAILED DESCRIPTION OF THE DRAWINGS

Figure 1:
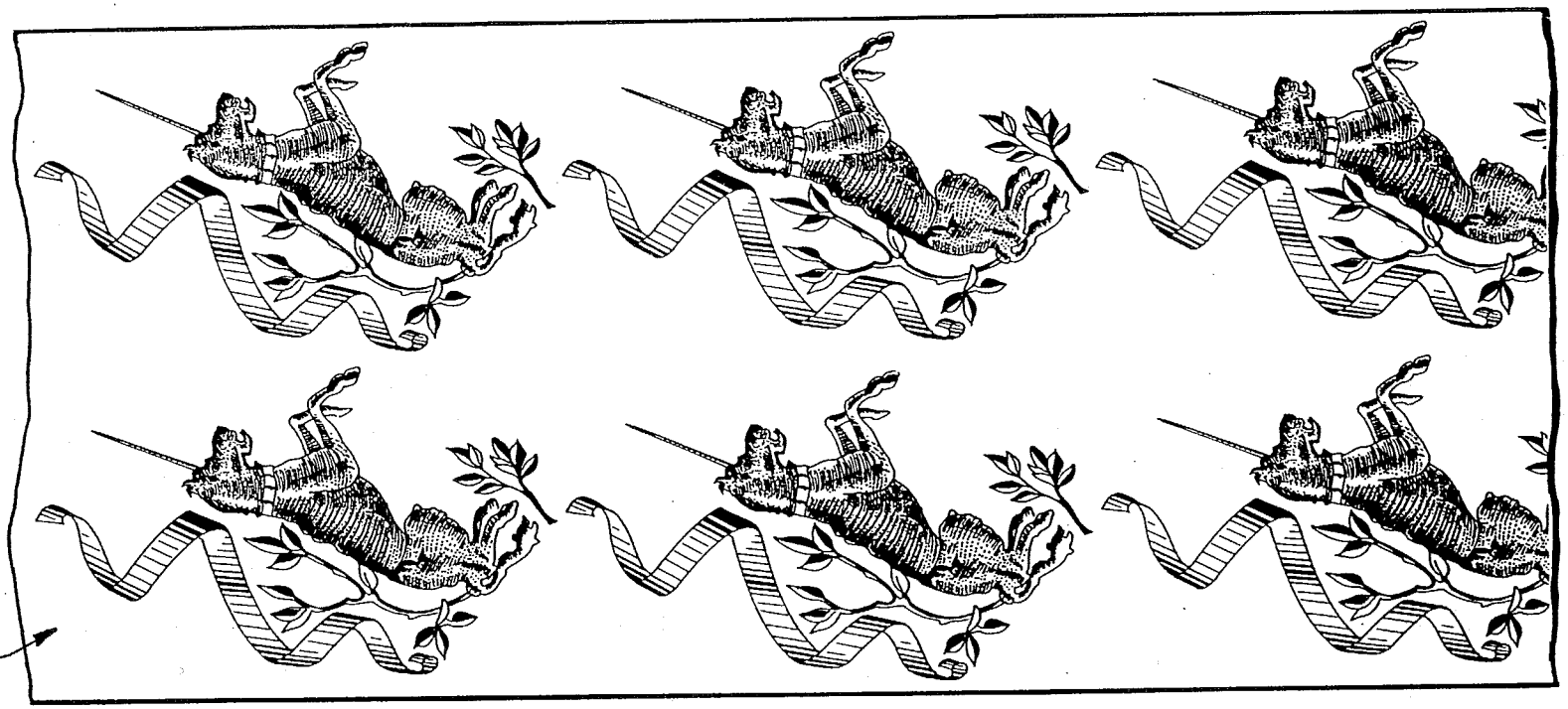
FIG. 1 PRIOR ART
FIG. 1 is a plan view of a pattern printed web of fabric as produced in the prior art.
Figure 2:
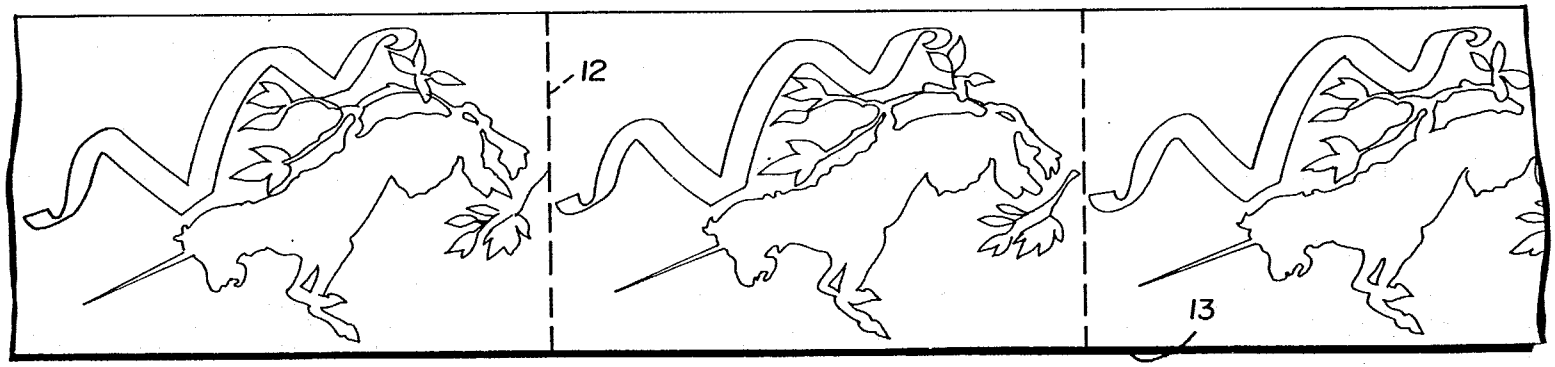
FIG. 2 PRIOR ART
FIG. 2 is a top plan view of the fabric of FIG. 1 folded over so that the sides thereof may be hemmed in the production of pillow cases, with desired cut lines illustrated in dotted line.

With reference to the prior art techniques of FIGS. 1 and 2, in the production of pillow cases, a length of pillow case material is produced, in this case the pillow case material having large patterns formed thereon and it being desirable to produce a final pillow case with each large pattern centered on each face of the pillow case. The length of pillow case material shown generally by reference numeral 10 in FIG. 1 is generally about twice the width of the final pillow case being produced, typically slightly wider than twice the width of the pillow case being produced. The length of pillow case material 10 can be fabric webs in which the web is originally printed with the web having a desired width, or the web may be much wider than necessary and having to be cut lengthwise to produce a roll of the material 10.

The web of pillow case material 10 is then folded over in a dimension perpendicular to the dimension of fabric movement A thereof, so that the pattern faces are disposed on top of each other, as illustrated schematically by the folded over length of pillow case material 11 illustrated in FIG. 2. The dotted lines 12 in the length of material 11 of FIG. 2 indicate desirable positions for cutting the pattern along its length. While in the position illustrated in FIG. 2, the hem is formed along the side 13 of the web. The web then passes to a detection station where a photo cell detects the leading edge of the web, or a pattern portion thereof, then stops. Next, rough cutting of a measured length takes place. Then the rough cut section is fine cut and hemmed along the dotted line portion 12 illustrated in FIG. 2, and the material is inserted and the final pillow case produced.

Figure 5:
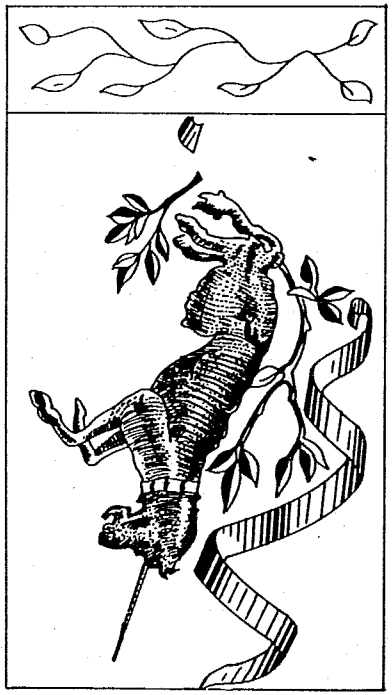
FIG. 5 PRIOR ART
FIGS. 3 and 5 are examples of prior art pillow cases that result if the cutting operation is not properly synchronized, with the undesired result that the pattern is not centered on the pillow case.
Figure 3:
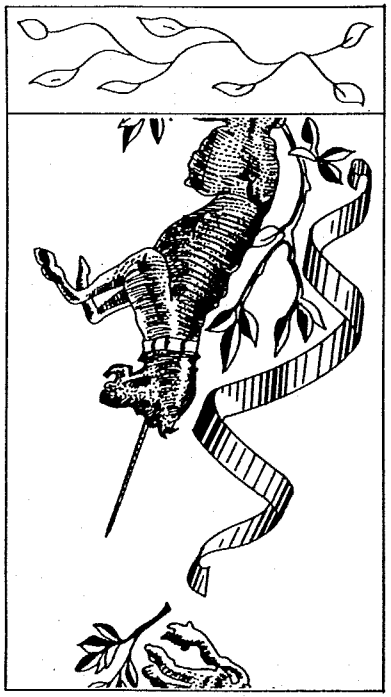
FIG. 3 PRIOR ART

Unfortunately, due to inaccuracies inherent in cutting a measured length rather than exactly on line with the pattern as shown by the idealized pattern lines 12 of FIG. 2, final products are often produced which are unacceptable. For example, the final pillow cases 14 and 15 of FIGS. 3 and 5 have the pattern off-center from the pillow case and can only be sold as seconds. Thousands of dollars are lost to manufacturers every year because of such miscutting, and despite the fact that there are significant losses due to miscutting the operation is more labor intensive than desired since it requires constant operator set-up and observation to be sure that the production of seconds is not even higher.

Figure 4:
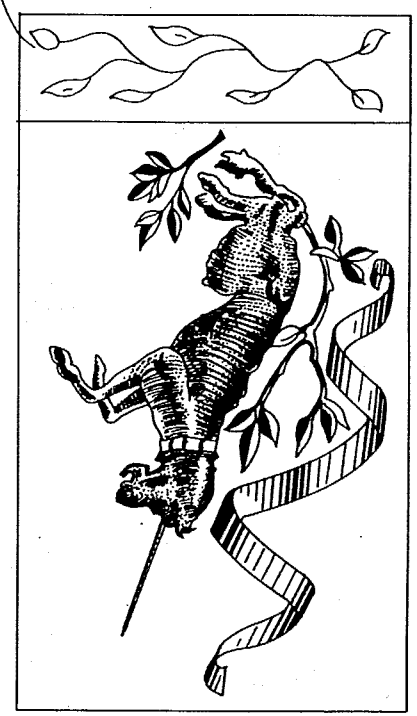
FIG. 4 is a top plan view of a pillow case with a pattern centered thereon, which is produced repeatedly according to the method of the present invention.

A desirable pillow case that is produced is illustrated by reference numeral 16 in FIG. 4. According to the method of the present invention, substantially all of the pillow cases produced can be produced automatically, or semi-automatically, having the configuration 16.

A box diagram illustrating an exemplary method according to the present invention is illustrated in FIG. 6. At a first step 20, a pattern is printed on a fabric web while the web is moving in a first direction. In synchronization with the pattern printing, at least one magnetic mark is disposed on the fabric web in a known position adjacent the pattern in the first direction. More magnetic marks may be provided if the marks are to define the perimeter of the fabric to be cut into panels in the production of apparel fabric, or the like, however in the case of the production of pillow cases only a mark in a second direction, perpendicular to the first direction, may be provided.

FIG. 6 illustrates primarily a process for the manufacture of pillow cases, and after the step 20 the pillow case material is folded over and side hemmed at station 21, as is conventional. At station 22, the magnetic mark is detected and the pillow case material rough cut, cutting taking place at a particular position with respect to the mark. At station 23, fine cutting and hemming takes place, and then ultimately the pillow case material is passed to a station 24 in which the material is inverted, and the final pillow case product is produced (as by adding the decorative edge panel indicated by reference numeral 26 in FIG. 4).

An exemplary station 20 is illustrated schematically in FIG. 7. The fabric web moving in the direction A is printed with the plurality of rollers 29, to print a pattern on the fabric. The rollers 29 may be, for example, screen print rolls each roll containing certain colors of dye to be placed on the fabric as it travels through the print range, and the rolls being synchronized so that the pattern is registered accurately on the fabric. Alternatively fluid jet printing may be provided.

According to the present invention printing of a magnetic mark is synchronized with the operation of the print rolls 29. This may be accomplished by providing a magnetic mark applying roll downstream of the rolls 29, or, as illustrated schematically in FIG. 7 by reference numeral 31, providing a fluid jet printing mechanism 31 which is synchronized with the rolls 29, and prints a mark of magnetic ink on the fabric web at a predetermined position with respect to the pattern (which is determined by the synchronization between the rolls 29 and the jet 31). The fabric then is dried in a conventional dryer 32, and then may be immediately passed to the station 21, or may be cut lengthwise, taken up into rolls, and the rolls utilized as the feed material for the station 21.

Figure 8:
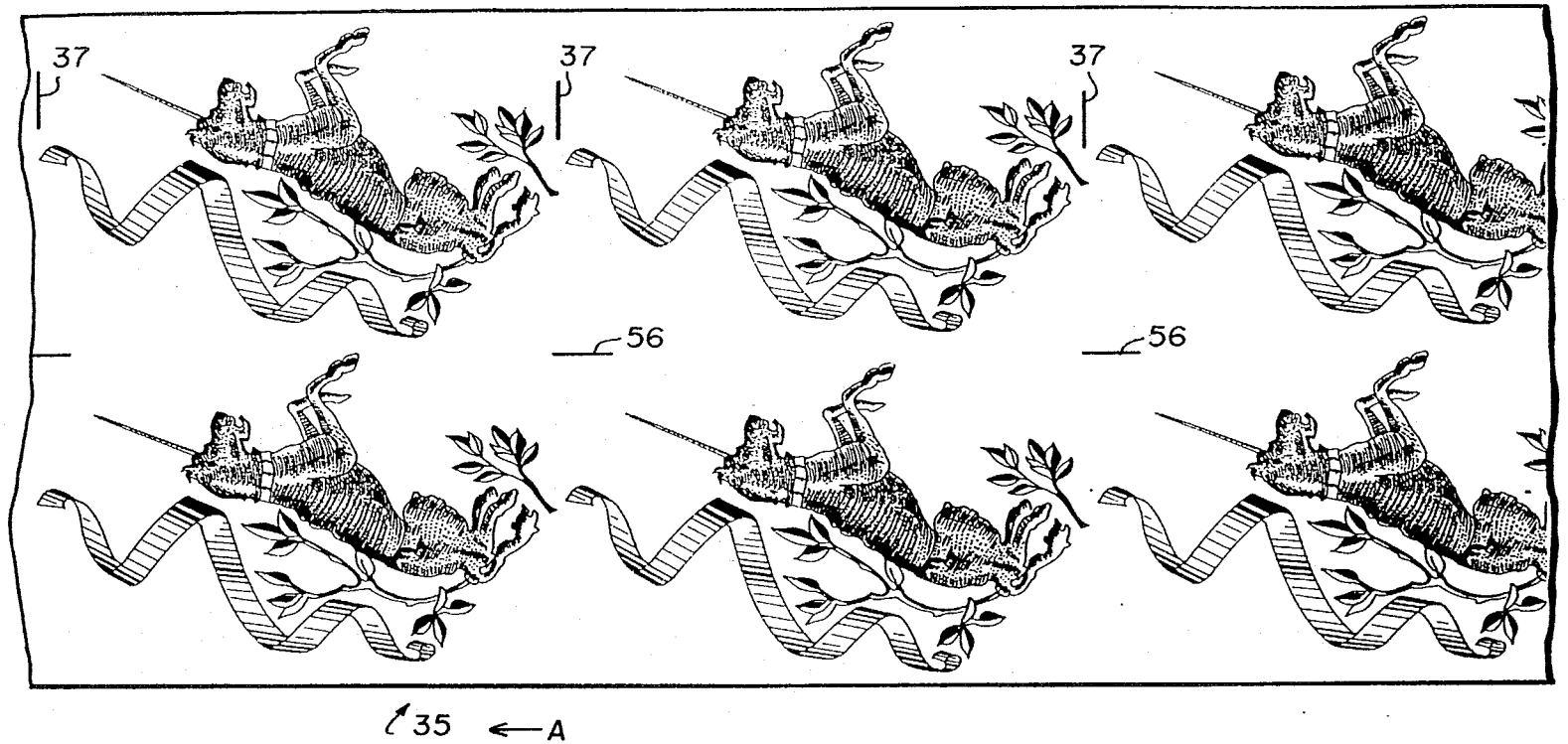
FIG. 8 is a top plan view illustrating a pattern fabric produced according to the invention.
Figure 9:
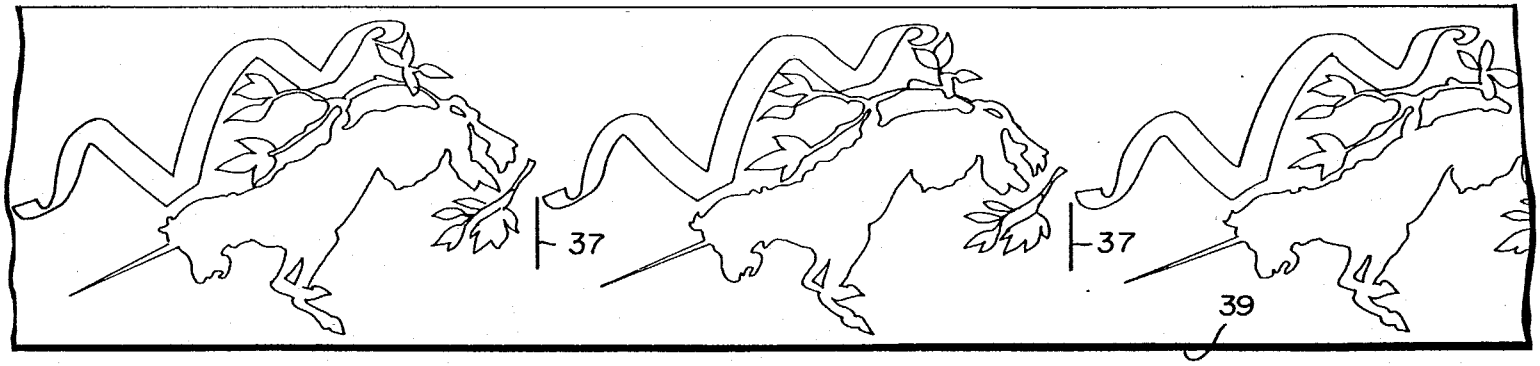
FIG. 9 is a top plan of the fabric of FIG. 7 after having been folded over, in the case of the manufacture of pillow cases.

A web portion of printed fabric which is the feed pillow case material is illustrated by reference numeral 35 in FIG. 8. Note the magnetic marks 37 which have been applied to the fabric web at—in this case—the position between the fabric patterns. When the web portion 35 is folded over as is conventional, and the side hem 39 produced, it will appear as illustrated in FIG. 9 by reference numeral 40. Note that the magnetic marks in this particular embodiment have been applied to the fabric web on the same face thereof as the pattern, but even so can be detected by a magnetic detector, and for clarity of illustrations the magnetic marks 37 are also illustrated as visible in FIG. 9.

Figure 10:
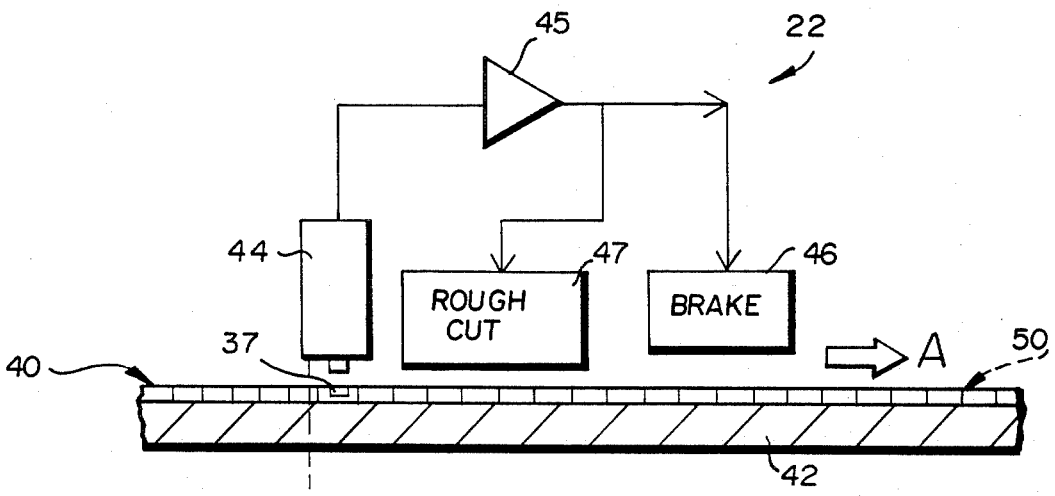
FIG. 10 is a side schematic view of the detection and rough cut step of the method of FIG. 7.

The side hem web portion 40 of FIG. 9 is then transported in the first direction A to the detecting and rough cutting station 22, which is schematically illustrated in FIG. 10. At station 22, the fabric web portion 40 moves in dimension A on a cutting table 42. A magnetic sensor 44 is positioned above the fabric table 42, and detects when the magnetic ink mark 37 passes by it. The signal from the magnetic detector 44 is amplified in amplifier 45, and then is fed to a conventional brake 46 and a rough cutter 47. The brake 46 stops the fabric almost at once at the proper point for the conventional cutter 47 to effect cutting. The fabric web portion 40 will be stopped by the brake 46 at a position where the mark 37 has just barely passed past the cutter blade of cutter 47.

Figure 11:
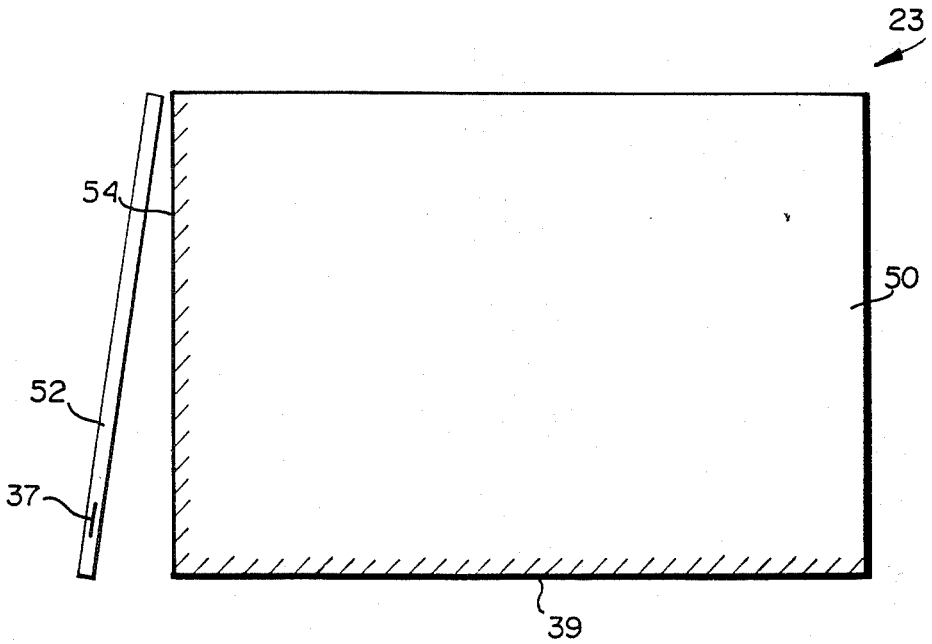
FIG. 11 is a top schematic view illustrating the fine cut and end hem step of the method of FIG. 6.

After rough cutting of the fabric web portion 40 into a pillow case blank, the pillow case blank, illustrated schematically by reference numeral 50 in FIG. 10 is then automatically removed from the cutting table 42 and moved to a conventional end hemming and fine cutting station 23, such a station being illustrated schematically in FIG. 11. At this station, a fine cut of the pillow case blank 50 is made, trimming off a section 52 which includes the magnetic mark 37 thereon, which section 52 is discarded. Preferably simultaneously with that fine cutting action, the end hem 54 is formed. This cutting and end hemming action can typically be performed with an automatic or semi-automatic sewing machine. The pillow case blank is then passed to a final station 24 in which it is inverted, and the final product is produced, again as by sewing on a front edge decorative portion as illustrated at 26 in FIG. 4. The pillow case 16 that is produced (see FIG. 4) has the pattern properly disposed in the center thereof.

While above the invention has been described with respect to the production of pillow cases, it is applicable to a wide variety of other techniques for producing textile products in which it is necessary to properly position a pattern. For example in the production of articles of apparel from patterned fabric, it may be desirable to apply magnetic ink along the perimeter of fabric panels that will ultimately be cut out. For example, for the fabric 35 illustrated in FIG. 8, it may also be desirable —if apparel panels are to be produced therefrom—to provide magnetic ink markings 56 along other portions of the fabric to define other portions of the perimeter of the final product to be produced. For example, if the magnetic ink marks 56 are provided to determine the width of a panel, other marks may be provided to determine its length; for instance the panel may be two patterns long and two patterns wide, and the appropriate magnetic marks 37, 56 would be provided to define the perimeter.

Detection and rough cutting of the fabric panels would take place in the same manner as for the pillow case, but in this instance the patterns would then be matched up when constructed into the final fabric. For example, since the panels have been accurately cut, they can be precisely matched up, side to side, as illustrated in FIG. 12, and hemmed at 60, with a bottom hem being provided at 61 if desired. For example the connected panel sections 62 illustrated in FIG. 12 could be utilized for the production of a shirt, or other item of apparel.

It will thus be seen that according to the present invention a method has been provided for facilitating the production of textile products from pattern printed fabric webs so that the patterns are always properly positioned in the final products produced. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and procedures.

What is claimed is:

1. A method of forming pattern printed textile products having the pattern properly positioned at desired locations on the textile product, comprising the steps of:

(a) printing a pattern on a fabric web susceptible to stretching or shrinking moving in a first direction;

(b) in synchronization with step (a), disposing a magnetic mark on the textile in a known position adjacent the pattern in the first direction;

(c) subsequently detecting the magnetic mark on the fabric web and cutting the web at a known position with respect to the mark to form a web section with a known position of a pattern thereon, the position of the cut relative to the known position of the mark lying closely adjacent one another such that the pattern is properly positioned on the cut web section; and (d) forming the web section into a final textile product.

2. A method as recited in claim 1 wherein the textile product being produced is a pillow case and comprising the further steps of: (e) providing the pattern printed web so that it defines a web portion moving in the first direction having a width generally equal to twice the width of the pillow case to be produced;

(f) folding the web section over in a dimension perpendicular to the first direction; and (g) producing a side hem on the folded over web portion; and wherein step (c) is practiced by:

(h) detecting the magnetic mark at each position adjacent the pattern, in the direction of web movement; and (i) rough cutting the web portion in a dimension perpendicular to the first direction in response to the web detection; and (j) fine cutting the web while forming an end seam adjacent the cut of the web portion.

3. A method as recited in claim 1 wherein step (b) is practiced by ink jet printing.

4. A method as recited in claim 1 wherein the final textile product produced is apparel fabric.

5. A method as recited in claim 1 wherein step (c) is practiced to cut off a section of the fabric web having the magnetic mark thereon.

6. A method as recited in claim 1 wherein steps (a) and (b) are practiced so that the magnetic mark is disposed on the same face of the fabric as the pattern.

7. A method as recited in claim 6 wherein step (c) is practiced to cut off a section of the fabric web having the magnetic mark thereon.

8. A method as recited in claim 6 wherein step (c) is practiced during transport of the fabric web passed a stationary detector while the face of the fabric having the pattern and magnetic mark thereon is opposite the face of the web that passes immediately in juxtaposition with the detector.

9. A method of forming a pattern printed pillow case comprising the steps of:

(a) printing a pattern on a fabric web while moving the web in a first direction, the fabric web being susceptible to stretching or shrinking;

(b) in synchronization with step (a) disposing a magnetic mark on the fabric web in a known position adjacent each pattern in the direction of fabric movement;

(c) providing a portion of the fabric web so that it has a width generally comparable to the width of the pillow case to be formed;

(d) folding over the web portion so that the pattern face of the web portion is folded in half, with the pattern faces abutting each other;

(e) forming a side hem on the web portion;

(f) detecting the magnetic mark on the web portion and rough cutting the web portion at a known position with respect to the mark, the cutting being performed in a direction perpendicular to the first direction to form a cut; and (g) fine cutting the web portion and forming an end seam at the cut, the position of the cut as set forth in step (f) relative to the known position of the mark lying closely adjacent one another and at least within a discrete pattern length.

10. A method as recited in claim 7 comprising the further step of inverting the side and end hemmed web portions so that the pattern appears on the outside of the pillow case produced.

11. A method as recited in claim 9 wherein step (b) is practiced by ink jet printing.

12. A method of forming a pattern printed textile product comprising the steps of:

(a) printing a pattern of a fabric web while moving in a first direction, the fabric web being susceptible to stretching or shrinking;

(b) in synchronization with step (a) disposing magnetic marks on the fabric web to define perimeter cut lines for subsequent use in manufacture of the textile fabric product from the fabric web;

(c) subsequently detecting the magnetic mark perimeter cut lines on the fabric, and cutting the fabric along the perimeter cut lines to produce fabric panels, the position of the cut lines relative to the position of the marks lying closely adjacent one another and at least within a distance less than the length a discrete panel extends in said first direction; and (d) forming the fabric panels into a final textile product.

13. A method as recited in claim 12 wherein step (d) is practiced by matching up the patterns on the panels and sewing a plurality of panels together to produce an item of apparel.

14. A method as recited in claim 13 wherein step (c) is practiced to cut off those portions of the fabric that have magnetic marks thereon.

15. A method as recited in claim 12 wherein step (c) is practiced to cut off those portions of the fabric that have magnetic marks thereon.

16. A method forming pattern printed textile products having the pattern properly positioned at desired locations on the textile product, comprising the steps of automatically:

(a) printing a pattern on a fabric web moving in a first direction, the fabric web being susceptible to stretching or shrinking;

(b) in synchronization with step (a), disposing a detectable mark, distinct from the pattern, on the textile in a known position adjacent the pattern in the first direction;

(c) subsequently detecting the mark on the fabric web and cutting the web at a known position with respect to the mark to form a web section with a known position of a pattern thereon, the position of the cut relative to the known position of the mark lying closely adjacent one another and at least within the length of the web section; and (d) forming the web section into a final textile product.

17. A method as recited in claim 16 wherein the textile product being produced is a pillow case and comprising the further steps of: (e) providing the pattern printed web so that it defines a web portion moving in the first direction having a width generally equal to twice the width of the pillow case to be produced;

(f) folding the web section over in a dimension perpendicular to the first direction; and (g) producing a side hem on the folded over web portion; and wherein step (c) is practiced by:

(h) detecting the mark at each position adjacent the pattern, in the direction of web movement; and (i) rough cutting the web portion in a dimension perpendicular to the first direction in response to the web detection; and (j) fine cutting the web while forming an end seam adjacent the cut of the web portion.

18. A method as recited in claim 16 wherein step (b) is practiced by ink jet printing.

19. A method as recited in claim 16 wherein steps (a) and (b) are practiced so that the detectable mark is disposed on the same face of the fabric as the pattern; and wherein step (c) is practiced during transport of the fabric web past a stationary detector while the face of the fabric having the pattern and detectable mark thereon is opposite the face of the web that passes immediately in juxtaposition with the detector.

20. A method of forming a pattern printed pillow case comprising the steps of:

(a) printing a pattern on a fabric web while moving the web in a first direction, the fabric web being susceptible to stretching or shrinking;

(b) in synchronization with step (a) disposing a detectable mark on the fabric web in a known position adjacent the pattern in the direction of fabric movement and to define web panels having discrete lengths;

(c) providing a portion of the fabric web so that it has a width generally comparable to the width of the pillow case to be formed;

(d) folding over the web portion so that the pattern face of the web portion is folded in half, with the pattern faces abutting each other;

(e) forming a side hem on the web portion;

(f) detecting the detectable mark on the web portion and rough cutting the web portion at a known position with respect to the mark, the cutting being performed in a direction perpendicular to the first direction to form a cut; and (g) fine cutting the web portion and forming an end seam at the cut.

21. A method forming pattern printed textile products having the pattern properly positioned at desired locations on the textile product, comprising the steps of:

(a) printing a pattern on a fabric web moving in a first direction;

(b) in synchronization with step (a), disposing a magnetic mark on the textile in a known position adjacent the pattern in the first direction;

(c) subsequently detecting the magnetic mark on the fabric web and cutting the web at a known position with respect to the mark to form a web section with a known position of a pattern thereon;

(d) forming the web section into a final textile product;

(e) providing the pattern printed web so that it defines a web portion moving in the first direction having a width generally equal to twice the width of the pillow case to be produced;

(f) folding the web section over in a dimension perpendicular to the first direction;

(g) producing a side hem on the folded over web portion; and wherein step (c) is practiced by:

(h) detecting the magnetic mark at each position adjacent the pattern, in the direction of web movement;

(i) rough cutting the web portion in a dimension perpendicular to the first direction in response to the web detection; and (j) fine cutting the web while forming an end seam adjacent the cut of the web portion; and wherein step (i) is practiced by temporarily stopping the movement of the web portion in the first direction and cutting while stopped; and wherein step (j) is practiced by simultaneously effecting cutting and end hemming, and practicing the cutting so that a portion of the fabric with the magnetic mark thereon is cut off.

22. A method as recited in claim 21 comprising the further step of inverting the side and end hemmed web portions so that the pattern appears on the outside of the pillow case produced.

23. A method of forming a pattern printed pillow case comprising the steps of:

(a) printing a pattern on a fabric web while moving the web in a first direction;

(b) in synchronization with step (a) disposing a magnetic mark on the fabric web in a known position adjacent the pattern in the direction of fabric movement;

(c) providing the fabric web so that it has a width generally comparable to the width of the pillow case to be formed;

(d) folding over the web portion so that the pattern face of the web portion is folded in half, with the pattern faces abutting each other;

(e) forming a side hem on the web portion;

(f) detecting the magnetic mark on the web portion and rough cutting the web portion at a known position with respect to the mark, the cutting being performed in a direction perpendicular to the first direction to form a cut; and (g) fine cutting the web portion and forming an end seam at the cut by simultaneously effecting cutting and end hemming, and practicing the cutting so that a portion of the fabric with the magnetic mark thereon is cut off.

24. A method as recited in claim 23 comprising the further step of inverting the side and end hemmed web portions so that the pattern appears on the outside of the pillow case produced.

25. A method of forming a pattern printed pillow case comprising the steps of:

(a) printing a pattern on a fabric web while moving the web in a first direction;

(b) in synchronization with step (a) disposing a magnetic mark on the fabric web in a known position adjacent the pattern in the direction of fabric movement;

(c) providing the fabric web so that it has a width generally comparable to the width of the pillow case to be formed;

(d) folding over the web portion so that the pattern face of the web portion is folded in half, with the pattern faces abutting each other;

(e) forming a side hem on the web portion;

(f) detecting the magnetic mark on the web portion and rough cutting the web portion at a known position with respect to the mark, the cutting being performed in a direction perpendicular to the first direction to form a cut; and (g) fine cutting the web portion and forming an end seam at the cut to cut off the magnetic mark from the final pillow case being produced.

26. A method of forming pattern printed textile pillow cases having the pattern properly positioned at desired locations on the textile pillow case, comprising the steps of automatically:

(a) printing a pattern on a fabric web moving in a first direction;

(b) in synchronization with step (a), disposing a detectable mark, distinct from the pattern, on the textile in a known position adjacent the pattern in the first direction;

(c) subsequently detecting the mark on the fabric web and cutting the web at a known position with respect to the mark to form a web section with a known position of a pattern thereon;

(d) forming the web section into a final textile product;

(e) providing the pattern printed web so that it defines a web portion moving in the first direction having a width generally equal to twice the width of the pillow case to be produced;

(f) folding the web section over in a dimension perpendicular to the first direction;

(g) producing a side hem on the folded over web portion; and wherein step (c) is practiced by:

(h) detecting the mark at each position adjacent the pattern, in the direction of web movement;

(i) rough cutting the web portion in a dimension perpendicular to the first direction in response to the web detection; and (j) fine cutting the web while forming an end seam adjacent the cut of the web portion; wherein step (i) is practiced by temporarily stopping the movement of the web portion in the first direction and cutting while stopped; and wherein step (j) is practiced by: simultaneously effecting cutting and end hemming, and practicing the cutting so that a portion of the fabric with the detectable mark thereon is cut off.

27. A method as recited in claim 26 comprising the further step of inverting the side and end hemmed web portions so that the pattern appears on the outside of the pillow case produced.

28. A method of forming a pattern printed pillow case comprising the steps of:

(a) printing a pattern on a fabric web while moving the web in a first direction;

(b) in synchronization with step (a) disposing a detectable mark on the fabric web in a known position adjacent the pattern in the direction of fabric movement;

(c) providing the fabric web so that it has a width generally comparable to the width of the pillow case to be formed;

(d) folding over the web portion so that the pattern face of the web portion is folded in half, with the pattern faces abutting each other;

(e) forming a side hem on the web portion;

(f) detecting the detectable mark on the web portion and rough cutting the web portion at a known position with respect to the mark, the cutting being performed in a direction perpendicular to the first direction to form a cut; and (g) fine cutting the web portion and forming an end seam at the cut by simultaneously effecting cutting and end hemming, and practicing the cutting so that a portion of the fabric with the detectable mark thereon is cut off.

* * * * *